US009791146B2

(12) United States Patent
Young

(10) Patent No.: US 9,791,146 B2
(45) Date of Patent: Oct. 17, 2017

(54) PROCESSED VAPOR MAKE-UP PROCESS AND SYSTEM

(71) Applicant: Ellis Young, Sedalia, CO (US)

(72) Inventor: Ellis Young, Sedalia, CO (US)

( * ) Notice: Subject to any disclaimer, the term of this patent is extended or adjusted under 35 U.S.C. 154(b) by 35 days.

(21) Appl. No.: 14/606,964

(22) Filed: Jan. 27, 2015

(65) Prior Publication Data

US 2015/0211731 A1 Jul. 30, 2015

Related U.S. Application Data

(60) Provisional application No. 61/931,783, filed on Jan. 27, 2014.

(51) Int. Cl.

| | |
|---|---|
| ***F01K 21/06*** | (2006.01) |
| ***F01K 13/00*** | (2006.01) |
| ***F01K 17/06*** | (2006.01) |
| ***F22D 5/00*** | (2006.01) |
| ***F22D 11/00*** | (2006.01) |

(52) U.S. Cl.

CPC ..... *F22D 5/00* (2013.01); *F01K 17/06* (2013.01); *F01K 21/06* (2013.01); *F22D 11/006* (2013.01); *F01K 13/00* (2013.01)

(58) Field of Classification Search

CPC ..... F01K 21/06; F01K 17/00; F01K 17/02; F01K 17/04; F01K 17/06; F01K 3/20; F01K 3/205; F01K 3/26–3/265; F01K 7/34; F01K 7/38; F01K 7/44; F22D 5/00; F28B 9/08

USPC ..... 60/646, 657, 667, 676, 678; 122/379–405

See application file for complete search history.

(56) References Cited

U.S. PATENT DOCUMENTS 1,564,716 A * 12/1925 Ruths ..... F22B 1/12 122/32
1,938,366 A * 12/1933 Armacost ..... F01K 17/00 60/499
3,194,217 A * 7/1965 Grabowski ..... F28G 9/00 122/379
3,243,961 A * 4/1966 Caracristi ..... F01K 3/22 122/406.4
3,264,826 A * 8/1966 Kane ..... F01K 3/245 60/646
3,298,359 A * 1/1967 West ..... C02F 9/00 122/379
3,769,795 A * 11/1973 Rostrom ..... F01K 23/108 122/401
3,953,966 A * 5/1976 Martz ..... F01K 13/02 60/39.182

(Continued)

FOREIGN PATENT DOCUMENTS

WO WO 2012108757 A2 * 8/2012 ..... F01K 3/004

*Primary Examiner* — Laert Dounis
(74) *Attorney, Agent, or Firm* — Leyendeck & Lemire, LLC

(57) ABSTRACT

A novel processed vapor make-up water subsystem that uses a make-up water boiler to boil and purify make-up water and its method of use are described. Upon vaporization, dissolved solids remain in the liquid water in the bottom of the make-up boiler and the solids free steam is introduced into the main boiler loop through a deaerator. Periodically, the water in the bottom of the make-up boiler is blown down when the amount of dissolved solids in the water reach a predetermined level.

13 Claims, 3 Drawing Sheets

(56) References Cited

U.S. PATENT DOCUMENTS

| | | | | | |
|---|---|---|---|---|---|
| 4,453,499 | A * | 6/1984 | Palmer | F22B 37/565 | 122/379 |
| 4,627,386 | A * | 12/1986 | Duffy | F01K 9/00 | 122/1 B |
| 5,048,466 | A * | 9/1991 | Rudd | F22B 29/12 | 122/406.4 |
| 5,724,814 | A * | 3/1998 | Ven | F01B 17/00 | 60/618 |
| 2012/0048215 | A1* | 3/2012 | Hicks | D21F 5/20 | 122/1 C |
| 2012/0144830 | A1* | 6/2012 | Ellert | F22D 1/50 | 60/641.8 |
| 2013/0263928 | A1* | 10/2013 | Inoue | F22D 5/26 | 137/11 |

* cited by examiner

PROCESSED VAPOR MAKE-UP PROCESS AND SYSTEM

RELATED APPLICATIONS

This application claims the benefit and priority to U.S. Provisional Patent Application No. 61/931,783 filed on Jan. 27, 2014 entitled Processed Vapor Make-up Process and System and having the same inventor as the present application.

BACKGROUND

Most power plants utilize a water/steam boiler system to energize a generator turbine and produce electricity. Because of the extremely high pressures and temperatures involved in the process, dissolved gasses and solids in the system water dramatically increase the deleterious effect on boilers steel and other metallic components.

A boiler circuit is largely but not a completely closed system, specifically, because solids are introduced into the water through make-up water, erosion, corrosion and other means. They need to be removed periodically or continuously to prevent build up from negatively impacting the function and efficiency of the system. Main boiler blow down is used to flush out the solids but also releases a small percentage of water from the system that needs to be replaced. Further, a small amount of water is lost in the form of steam vented out of a deaerator and through soot blowers in coal fired plants.

Make-up water subsystems are employed to replace the flushed water. FIG. 1 illustrates a typical power plant steam boiler system and its prior art make-up water subsystem. The make-up water subsystem acts to remove most of the dissolved solids in the make-up water to a level below 250 parts per million depending on boiler pressure prior to introduction into the main boiler 110. Prior art systems typically employ various chemical compounds using both cation and anion ion exchange resins and/or reverse osmosis (RO) membranes to remove dissolved solids from unprocessed well (or raw) water. The process results in deionized or RO water that is largely solids-free.

Referring to FIG. 1, the operation of a typical power plant steam boiler system 100 is described with reference to the flow of steam and water in the boiler loop. The water contained in the main boiler 110 is heated to extremely high temperatures (up to 1050 degrees F.) and maintained at extremely high pressures (from 1200-3550 psig). A suitable heat source 111 is provided to heat the boiler and steam contained therein and may be fueled by coal, natural gas, nuclear or any other suitable energy source. The superheated pressurized steam is funneled to an electric turbine generator 112 through one or more connecting pipes 118. The thermal energy of the steam is converted to mechanical energy spinning a turbine which in turn is converted to electricity. The spent steam is directed through a conduit exiting the generator and into a condenser tank 114 wherein the steam condenses into water at about 90-120 degrees F. Typically, the tank is maintained at low pressure or even a vacuum relative to ambient.

The condensed water is then fed into a deaerator 116 by one or more conduits 122. A small amount of the steam from the pressurized steam pipes 118 extending between the main boiler and the electric generator is diverted and piped into the deaerator. The deaerator includes a pressure release vent and through this maintains the pressure in it to a desired level of about 5-60 psi depending on the particular application. As the cool condensed water is received in the deaerator, the steam heats it to 250-300 F and deaerates it freeing and venting any previously dissolved oxygen and other gasses to atmosphere through the vent. The deaerated water pools at the bottom of the deaerator and is fed back into the boiler to repeat the cycle.

As mentioned above a small amount of water is lost from the otherwise closed boiler loop when steam is vented out of the deaerator's vent. A much larger amount of water is removed from the system through boiler blown down. Overtime, small amounts of solids, such as from the walls of the boiler and pipes, dissolve into the boiler water and steam. If the level of dissolved solids reaches too high a level the contaminants can accelerate the corrosion and erosion of internal surfaces within the closed system. Accordingly, a blown down valve 126 and associated piping 128 is provided near the base of the main boiler where any solids may collect. Periodically, and when sensors located in the system indicated that the solid level is close to or exceeds 250 ppm, the blow down valve is opened to release a portion of the water along with particulate and dissolved solid contained in it to atmosphere. In addition to a loss of system water, which must be made up and replaced, the heat energy contained in the water is lost. While the lost heat energy is low relative to the energy output of the system, the value of the energy over the course of months and years can represent a measurable and significant amount. Furthermore, the treatment of make-up water to remove dissolved solids and other contaminants therefrom represents a sizable and significant cost over time.

A typical prior art make-up water subsystem 130 utilizes water from a well 132 or other suitable source. As can be appreciated well water wherein chlorine and other additives have not been introduced into the water is preferred since any additives have to be removed by the make-up water subsystem before the water can be introduced into the boiler loop. The water make-up subsystem includes a means for pumping water from a well 132, a means for scrubbing the water to remove particulate and dissolved solids, and a pipe 134 or pipes coupled with the boiler loop to introduce the make-up water therein. In the illustrated prior art subsystem, the means for scrubbing the water comprises a series of tanks 136 & 138 filled with cation resins and anion resins through which the water passes and solids are removed. In other makeup water subsystems reverse osmosis membranes can be used in combination with or in place of the cation and anion tanks.

While the prior art systems are very effective, over time they can be expensive requiring tens of thousands of dollars in chemicals, lost water, or reverse osmosis filters and membranes annually for a small to medium-sized power plant. Additional inefficiencies occur from the loss of heat energy in the flushing of very high temperature water during boiler blow down.

DETAILED DESCRIPTION

Figure 1:
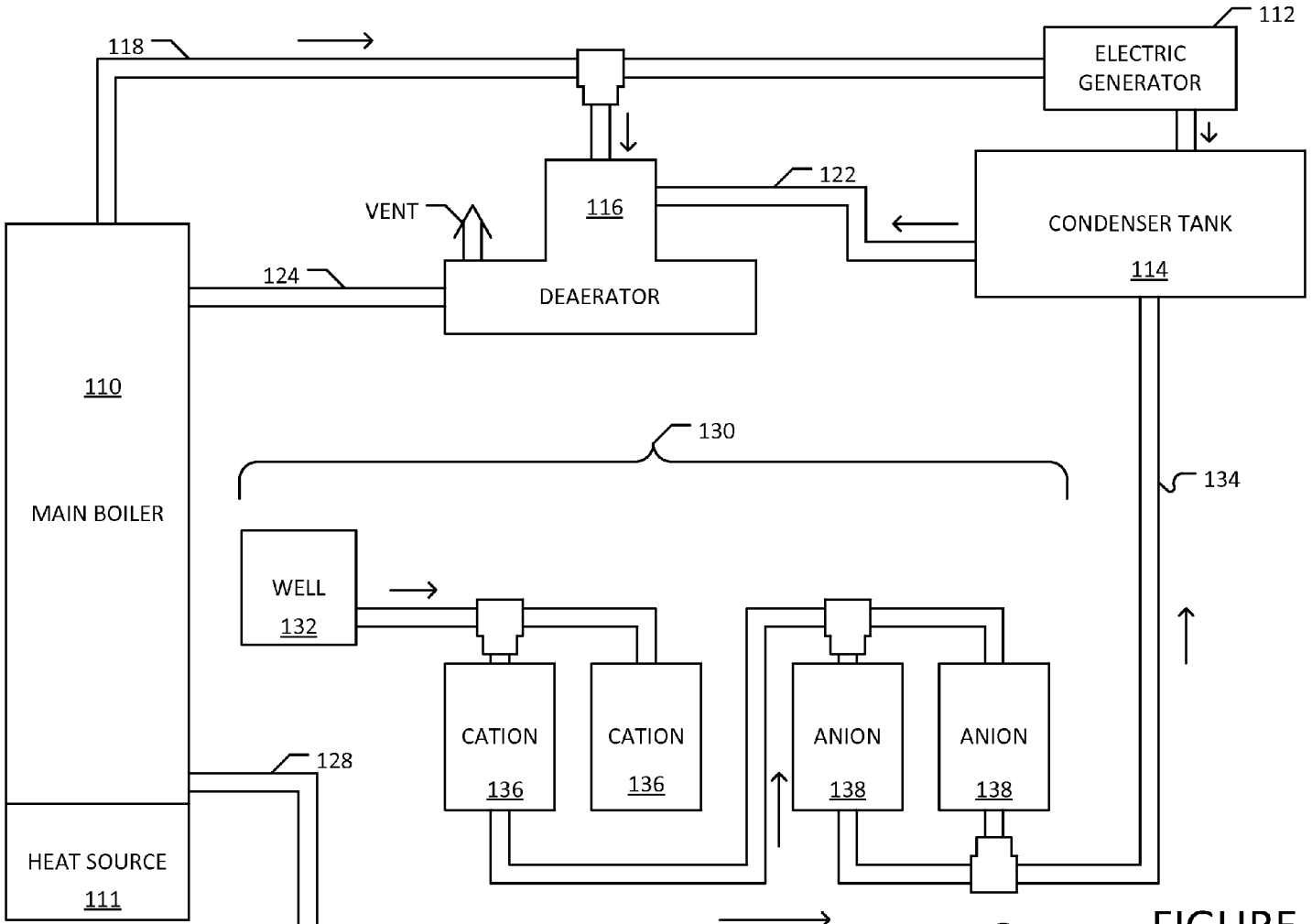
FIGURE 1 (Prior Art)
FIG. 1 is a block diagram of a steam boiler of a power plant including a typical prior art make up water system.

Embodiments of the present invention comprise a novel processed vapor make-up water subsystem that uses steam from the main boiler loop and blow down water to heat and vaporize make-up water in a make-up water boiler. Upon vaporization, dissolved solids remain in the liquid water in the bottom of the make-up boiler and the solids-free steam is introduced into the main boiler loop through a deaerator. Periodically, the water in the bottom of the make-up boiler is blown down when the amount of dissolved solids in the water reach a predetermined level.

The use of a processed vapor make-up water subsystem that uses of heat energy already being generated by the boiler system including heat energy that would otherwise be lost reduces the need for a reverse osmosis or cation/anion subsystem and accordingly reduces the operating costs of the associated power plant. It is to be appreciated that a reverse osmosis and/or cation/anion subsystem may be utilized for initial fillings of the main boiler loop from a dry or drained state prior to commencing operation of the power plant.

Embodiments also comprise the methodology of operating the boiler system including the processed vapor make-up water subsystem Terminology The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

The terms "removable", "removably coupled", "removably installed," "readily removable", "readily detachable", "detachably coupled", "separable," "separably coupled," and similar terms, as used in this specification and appended claims, refer to structures that can be uncoupled, detached, uninstalled, or removed from an adjoining structure with relative ease (i.e., non-destructively, and without a complicated or time-consuming process), and that can also be readily reinstalled, reattached, or coupled to the previously adjoining structure.

Directional or relational terms such as "top," bottom," "front," "back," "above," "beneath," and "below," as used in this specification and appended claims, refer to relative positions of identified elements, components, or objects, where the components or objects are oriented in an upright position as normally installed or used.

The terms "conduit", "pipe" and their plurals are used interchangeably herein and refer to any suitable means of conveying a fluid, which in the instant document comprise water and steam.

Figure 2:
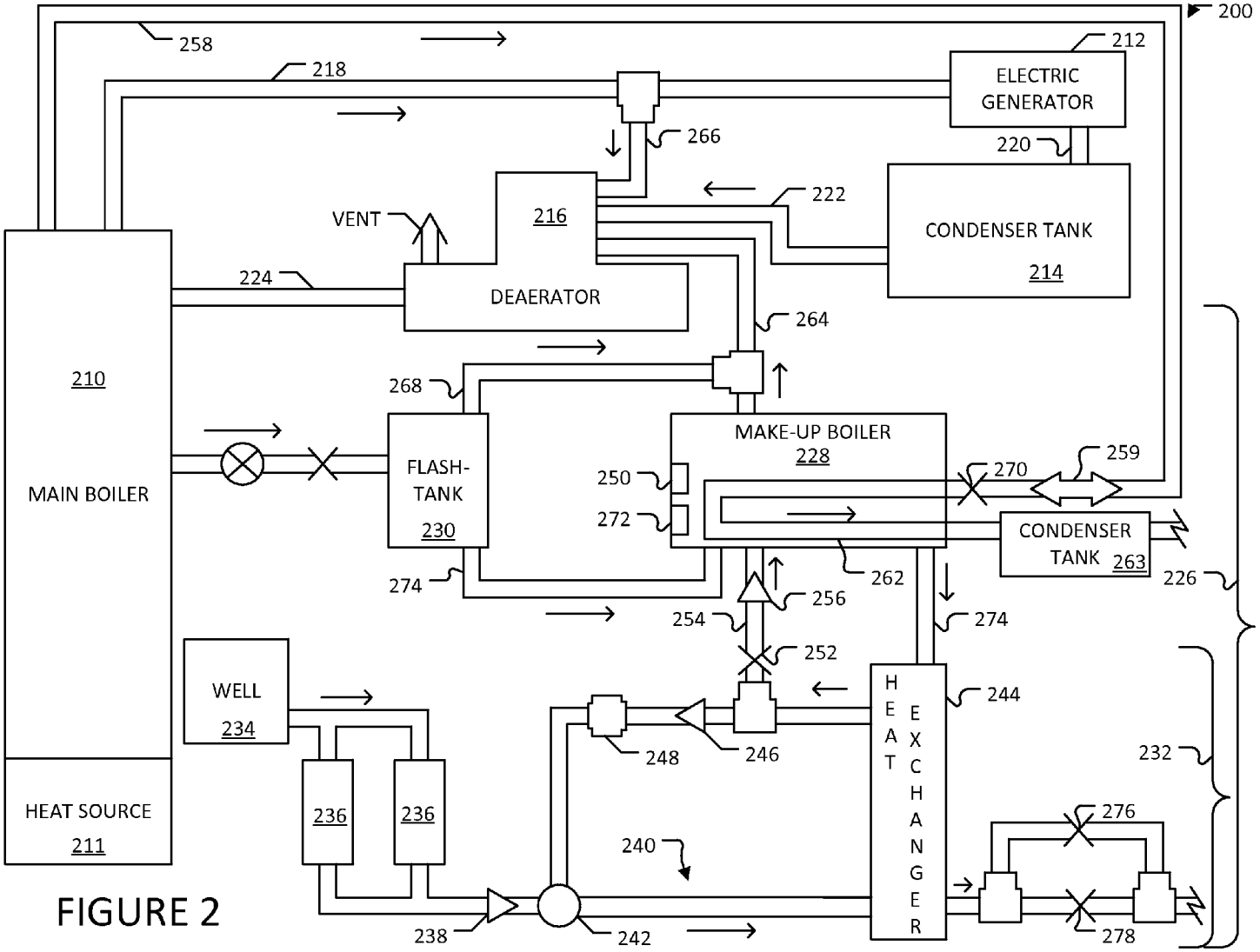
FIG. 2 is a block diagram of a steam boiler of a power plant incorporating a processed vapor make-up water subsystem according to one embodiment of the present invention.

A First Embodiment of Steam Boiler System with a Processed Vapor Make-Up Subsystem As illustrated in FIG. 2, a steam boiler system 200 of a power plant is shown incorporating a processed vapor make-up subsystem 226. It is to be appreciated that the make-up subsystem comprises several elements, which may be omitted in some variations, including: (i) a makeup boiler 228 for creating steam/vapor from the make-up water and thereby removing any dissolved solids therefrom; (ii) a flash tank 230 and associated plumbing to provide boiler water to the make-up boiler for treatment and eventual blow down; and (iii) a make-up water supply subsystem 232 to provide make-up water to the make-up boiler.

The processed vapor make-up subsystem is typically incorporated into a steam boiler system, such as that which may be used in a power plant as shown in FIG. 2, but the system can be incorporated into other boiler systems that serve other purposes other than use in generating power.

The operation of the power plant and specifically the main boiler loop is generally similar to the operation of the prior art system of FIG. 1. Superheated and pressurized steam is created in the main boiler 210 upon heating by a suitable heat source 211 and is directed to an electric generator 212 through one or more pipes 218. In the electric generator much of the steam's thermal energy is converted into electricity. The spent steam exits the generator and flows through conduit 220 into a condenser tank 214 wherein it condenses into water having a temperature of about 90-120 F. The condensed water is then fed into the deaerator 216 by way of one or more pipes 222 wherein it is heated and deaerated in a similar manner as discussed above. Finally, the deaerated water is funneled back into the main boiler through one or more pipes 224 to repeat the process again.

The process vapor make-up subsystem of FIG. 2 interfaces with the boiler loop by way of a conduit 264 that feeds processed steam from the make-up boiler 228 into the deaerator 216. The original source of make-up water used in the make-up subsystem 226 is typically a well 234, which usually supplies water when needed at 1-5 gpm. The well water is first softened by conventional means using water softeners 236. The softened water is fed past a one way check valve 238 into a circulation loop 240 that includes a feed pump 242 that provides the initial pressurization of the softened well water to about 140 psi and facilitates the circulation of the water in the loop. The circulation loop includes make-up water heat exchanger 244 where heat from high temperature blow down water from the make-up boiler water is transferred in part to the well water. Normally, the pressurized softened make-up water circulates in the loop which includes various valves to ensure the proper direction of flow and desired pressure are maintained including a one way check valve 246 and a 100 psi bypass valve 248. When make-up water is required by the make-up subsystem as is measured by a level gauge 250 in the makeup boiler 228, an associated signaling switch opens a motorized valve 252 located on a pipe spur 254 off of the circulation loop that permits the flow of approximately 100 psi make-up water through a one way valve 256 and into the make-up boiler. The valve closes once the water level in the make-up boiler increases to a desired level.

The make-up boiler is heated by superheated and pressurized steam that is funneled through piping 258 from the main boiler when motorized valve 270 is opened response to sensors indicating the need for make-up water in the main boiler loop, through a pressure reducing valve 259 to reduce the steam to about 150 psi, and through heat exchanging piping 262 contained in the make-up boiler to heat the pooled make-up water. After exiting the make-up boiler the steam is condensed in a condenser tank 263 and passed to the deaerator 216 for deaeration and resupply to the main boiler. The piping from the condenser tank to the deaerator is not shown. Two separate and distinct condenser tanks 214 & 263 are shown in FIG. 2; however, it is appreciated that the spent steam from the make-up boiler could be routed into the primary condenser tank 214 obviating the need for a second condenser tank.

The make-up water pooled in the make-up boiler 228 after being heated by the main boiler steam boils creating solid and dissolved gas free steam, which is typically maintained within the boiler at about 60 psi. The steam is passed through a pipe 264 and into the deaerator where it acts to help deaerate the condensed water being provided to the deaerator from the condenser 214, but additionally upon condensation adds water to the main boiler loop. As shown and as can be appreciated, since the make-up boiler is only operative when make-up water is needed in the main boiler loop other sources of steam for the deaerator are provided to permit continuous operation. A spur pipe 266 can be provided from the piping extending between the main boiler and the make-up boiler to supply super heated steam. Further, piping 268 can be provided from the flash tank, which is described below, to the deaerator to supply steam.

As can be appreciated, overtime as more of the make-up water is transformed into steam, the level of dissolved solids in the remaining make-up boiler water pool increases. Above a certain level of dissolved solids in the make-up water, dissolved solids can be carried with the resulting steam so it is imperative that a portion of the water in the make-up boiler 228 is periodically purged or blown down. Incidentally, to substantially eliminate the risk of the introduction of additional solids into the system by way of corrosion, the make-up boiler and many of the other components of the processed vapor make up system can be comprised of stainless steel. Components made of other steels can be used as well with suitable chemical treatment. One or more dissolved solids sensors 272 are provided in the boiler to measure the level of dissolved solids in the pooled make-up water. A pipe or pipes 274 are provided that extend between the bottom of the make-up boiler 228 and the make-up water heat exchanger 244 as described above. Additional pipes are provided on the heat exchanger to dispose of the blow down water. On these pipes, one or more motorized valves 276 & 278 are provided. At least one of these valves is activated when either (i) the conductance level of the water contained in the make-up boiler becomes too high as measured by the dissolved solids sensor(s) 272 or (ii) when the makeup boiler water level rises too high as measured by a level gauge 250. Ideally, the blow down water has a temperature of 60-100 F when discharged because most of its heat has been transferred to make-up water in the circulating loop 240.

As indicated above, on occasion it is also desirable to blow down a small percentage of the water in the main boiler 210 to remove dissolved solids in the boiler loop and lower the average amount of dissolved solids to below a desired level (usually less than 250 ppm but the level is ultimately dependent on the boiler pressure and the particular boiler). With reference to FIG. 2, initially the blown down water is piped into a flash tank 230 where it expands reducing pressure and temperature. Some of the steam generated in the flash tank can be routed to the deaerator 16 through a pipe 268. The condensed flash tank water is then pumped or gravity fed into the make-up boiler 228 through a pipe 274 where it mixes with the rest of the make-up boiler water and as applicable transfers some of its heat energy to the cooler water contained therein. As can be appreciated, the water from the main boiler may raise the level of dissolved solids in the make-up boiler which if high enough will trigger the dissolved solids sensor 272 to initiate make-up boiler blow down as discussed above.

Figure 3:
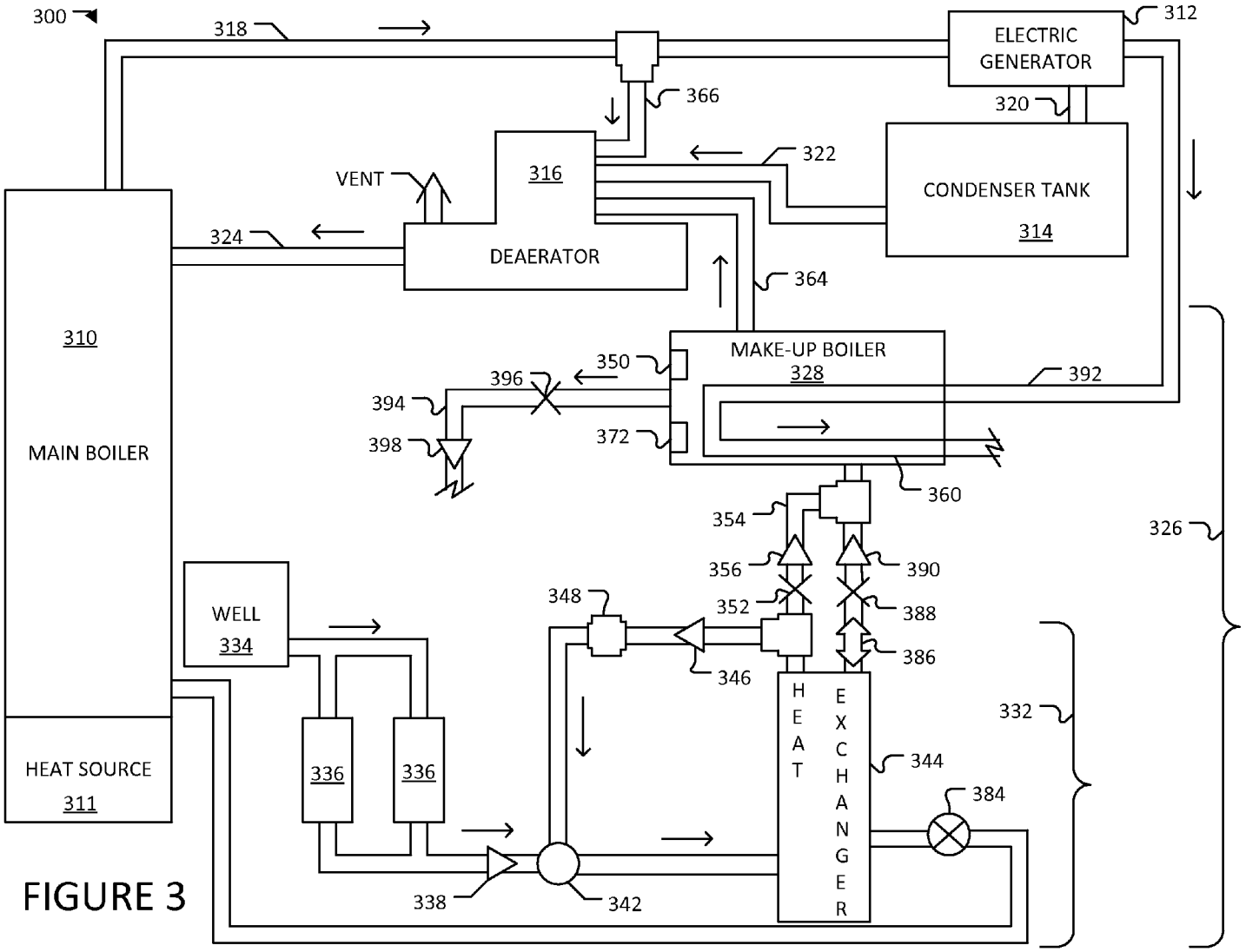
FIG. 3 is a block diagram of a steam boiler of a power plant incorporating a processed vapor make-up system water subsystem according to another embodiment of the present invention.

A Second Embodiment of Steam Boiler System with a Processed Vapor Make-Up Subsystem As illustrated in FIG. 3, another embodiment of a steam boiler system 300 of a power plant incorporating a processed vapor make-up subsystem 326 is shown. In general, the operation of the boiler system and the make-up subsystem is substantially similar to the subsystem described with reference to FIG. 2. For ease of reference and understanding, element numbers in FIG. 3 beginning with the number 3 and ending in the same two digits as an element number from FIG. 2 reference substantially identical elements or components. For instance, the make-up boiler of FIG. 3 is referenced as element number 328 and is substantially similar to the make-up boiler of Figure two which is identified by reference number 228.

In similar operation to the boiler loop of FIG. 2, high pressure superheated steam from the boiler 310 is fed through a pipe 318 to an electric generator 312 wherein the energy from the steam is converted into electrical energy. Most of the spent steam is funneled into a condenser 314 through one or more pipes 320. The condensed water is then fed into the deaerator 316 through one or more pipes 322 where it is deaerated and eventually fed back into the boiler through another set of pipes 324 to complete the loop.

The process vapor make-up subsystem of FIG. 3 interfaces with the boiler loop by way of a conduit 364 that feeds processed steam from the make-up boiler 328 into the deaerator 316. The original source of make-up water used in the make-up subsystem 326 is typically a well 334, which usually supplies water when needed at 1-5 gpm. The well water is first softened by conventional means using water softeners 336. The softened water is fed past a one way check valve 338 and pressurized into a circulation loop 340 that includes a feed pump 342 that provides the initial pressurization of the softened well water to about 140 psi and facilitates the circulation of the water in the loop.

The circulation loop includes make-up water heat exchanger 344 where high temperature blow down water from the main boiler 310 is fed into the exchanger through a conduit when control valve 384 is opened and its heat is transferred in part to the make-up water. The boiler blow down water is fed into the make-up boiler 328 after exiting the heat exchanger. A pressure reducing valve 386 is provided to lower the pressure of the blow down water to an amount similar to that of the softened make-up water (approximately 100 psi). A one way check valve 390 and a motorized valve 388 are also provided to control the flow of blow down water into the make-up boiler as needed or desired.

Normally, the pressurized softened make-up water circulates in the loop 340, which includes various valves to ensure the proper direction of flow and desired pressure are maintained including a one way check valve 346 and a 100 psi bypass valve 348. When make-up water is required by the make-up subsystem as is measured by a level gauge 350 in the makeup boiler 328, an associated signaling switch opens a motorized valve 352 located on a pipe spur 354 that extends from the heat exchanger and permits the flow of approximately 100 psi make-up water through a one way valve 356 and into the make-up boiler. The valve closes once the water level in the make-up boiler increases to a desired level.

The make-up boiler 328 is heated by a portion of the steam that is funneled through piping 392 after exiting the electric generator the main boiler and through heat exchanging piping 360 contained in the make-up boiler to heat the pooled make-up water. After exiting the make-up boiler the steam is fed into one of the condenser 314 or the piping 322 after the condenser leading to the deaerator 316. The destination of the piping after exiting the make-up boiler is not shown.

The make-up water pooled in the make-up boiler 328 after being heated by the main boiler steam boils creating solid and dissolved-gas free steam, which is typically maintained within the boiler at about 60 psi. The steam is passed through a pipe 364 and into the deaerator. As shown and as can be appreciated, since the make-up boiler is only operative when make-up water is needed in the main boiler loop other sources of steam for the deaerator are provided to permit continuous operation. A spur pipe 366 can be provided from the piping extending between the main boiler and the electric generator to supply super heated steam.

As can be appreciated, overtime as more of the make-up water is transformed into steam and as blown down water from the main boiler is pooled in the make-up boiler, the level of dissolved solids in the remaining makeup boiler water increases. Above a certain level of dissolved solids in the make-up water, dissolved solids can be carried with the resulting steam so it is imperative that a portion of the water in the make-up boiler 328 is periodically purged or blown down. One or more dissolved solids sensors 372 are provided in the boiler to measure the level of dissolved solids in the pooled make-up water. A pipe or pipes 394 are provided that when a motorized valve 396 is opened pump blow down water out of the boiler system. A one way check valve 398 is typically provided to prevent back flow. The amount of blow down water is typically small especially when compared to blow down from traditional prior art systems since a portion of the blow down from the main boiler is reintroduced into the boiler loop as solid-free steam created by the make-up boiler. However, depending on the economics much of the heat contained in the blow down make-up boiler water can be extracted by running the water through a heat exchanger, such as the heat exchanger 344 of the circulation loop.

VARIATIONS AND OTHER EMBODIMENTS

It is appreciated that many variations and alternative embodiments of the process vapor make-up system are contemplated as would be obvious to one or ordinary skill in the art given the benefit of this disclosure. For instance, in its simplest form the make-up water subsystem can be provided without a circulation loop and associated heat exchanger. Rather well water or water from other sources can be softened (as necessary), pressurized and introduced directly into the make-up boiler. Energy would be lost as blow down water is purged from the system but with the economics of some power plants, the cost to install a heat exchanger and the associated circulation loop may not be cost effective. As can also be appreciated the source of steam used to heat the make-up boiler and boil the make-up water can be provided from various locations along the boiler loop whether tapped directly from the main boiler, directed from the electric generator or tapped from some other suitable point along the loop.

In an even more significant variation, the heat source for the make-up boiler can come from some other means. For instance, the make-up boiler can be electrically heated using electrical energy created by the electrical generator. While using electric resistance heating instead of steam may be less efficient, the reduced cost of installing such a system may be an overriding consideration for some power plants.

I claim:

1. A closed loop steam boiler system comprising:

a first boiler configured to produce a high pressure high temperature steam flow;

a turbine-generator fluidly coupled to the first boiler and configured to receive the high pressure high temperature steam flow from the first boiler and generate electricity therefrom;

a deaerator fluidly coupled to the turbine-generator, the deaerator configured to receive water condensed from the steam and deaerate the condensed water;

at least one conduit extending between the deaerator and the first boiler, the one conduit configured to carry the condensed water from the deaerator to the first boiler; and a make-up water subsystem, the make-up water subsystem including, (i) a second boiler including one or more heat exchange pipes passing therethough to act as a heat source, the second boiler configured to generate make-up steam from make-up water contained therein, the second boiler being comprised substantially of stainless steel, (ii) one or more first conduits fluidly coupling the second boiler to a water source configured to provide the make-up water to the second boiler, (iii) one or more second conduits fluidly coupling the second boiler to the deaerator, and being configured to provide make-up steam to the deaerator, the one or more second conduits being substantially comprised of stainless steel, and (iv) one or more third conduits and a valve having open and closed positions fluidly coupling the one or more heat exchange pipes with the first boiler to provide high pressure high temperature steam flow, wherein a portion of the high pressure high temperature steam flow normally provided to the turbine-generator is diverted to the one or more heat exchange pipes when the valve is opened.

2. The closed loop steam boiler system of claim 1, wherein the make-up subsystem further comprises:

one or more fourth conduits including a first actuation valve contained therein, the fourth conduits configured to facilitate the flow of make-up water out of the second boiler as blow down water;

one or more fifth conduits fluidly extending between the first and second boilers; the fifth conduits including one or more third actuation valves to permit the flow of water or steam from the first boiler to the second boiler when opened; and a flash tank, the flash tank being located between the first boiler and the second boiler along the fourth conduits permitting the flow of water or steam therethrough;

wherein blow down of the first boiler comprises opening the one or more third actuation valves to permit the flow of water or steam from the first boiler to the second boiler within the fifth conduits and through the flash tank.

3. The closed loop steam boiler system of claim 1, further including a condensation tank located fluidly between the turbine-generator and the deaerator.

4. The closed loop steam boiler system of claim 1, further comprising a level sensor within the second boiler, the level sensor being operatively coupled to one or more second actuation valves located along the one or more first conduits.

5. The closed loop steam boiler system of claim 2, further comprising a dissolved solids sensor located within the second boiler, the dissolved solids sensor being operatively coupled to the first actuation valve.

6. The closed loop steam boiler system of claim 1, wherein the one or more first conduits comprise components of a make-up water supply subsystem, the make-up water supply subsystem including one or more water softeners configured to treat make-up water from the water source and a circulation loop, the circulation loop further including one or more pieces of conduit, a pump and a heat exchanger wherein pressurized make-up water is circulated in the circulation loop passing through the heat exchanger to scavenge heat therefrom.

7. A closed loop steam boiler system comprising:

a first boiler configured to produce a high pressure high temperature steam flow;

a turbine-generator fluidly coupled to the first boiler and configured to receive the steam flow from the first boiler and generate electricity therefrom;

a deaerator fluidly coupled to the turbine-generator, the deaerator configured to receive water condensed from the steam and deaerate the condensed water;

at least one conduit extending between the deaerator and the first boiler, the one conduit configured to carry the condensed water from the deaerator to the first boiler; and a make-up water subsystem, the make-up water subsystem including, a second boiler including a heat source configured to generate make-up steam from make-up water contained therein, the second boiler being comprised substantially of stainless steel, one or more first conduits fluidly coupling the second boiler to a water source configured to provide the make-up water to the second boiler, one or more second conduits fluidly coupling the second boiler to the deaerator, and being configured to provided make-up steam to the deaerator, the one or more second conduits being substantially comprised of stainless steel, one or more third conduits including a first actuation valve contained therein, the third conduits configured to facilitate the flow of make-up water out of the second boiler as blow down water, one or more fourth conduits fluidly extending between the first and second boilers; the fourth conduits including one or more third actuation valves to permit the flow of water or steam from the first boiler to the second boiler when opened, a flash tank, the flash tank being located between the first boiler and the second boiler along the fourth conduits permitting the flow of water or steam therethrough, wherein the blow down of the first boiler comprises opening the one or more third actuation valves to permit the flow of water or steam from the first boiler to the second boiler within the fourth conduits and through the flash tank; and wherein the one or more first conduits also comprise components of a make-up water supply subsystem, the make-up water supply subsystem including one or more water softeners configured to treat make-up water from the water source, and a circulation loop, the circulation loop further including one or more pieces of conduit, a pump and a heat exchanger wherein pressurized make-up water is circulated in the circulation loop passing through the heat exchanger to scavenge heat therefrom, and wherein the one or more third conduits pass through the heat exchanger operatively acting to transfer heat from the blow down water received into the heat exchanger from the second boiler to the make-up water.

8. The closed loop steam boiler system of claim 6, further comprising one or more sixth conduits, the sixth conduits extending from the first boiler through the heat exchanger and into the second boiler, wherein blow down water from the first boiler is passed through the heat exchanger operatively acting to transfer heat to the make-up water before being released in the second boiler.

9. A method of providing make-up water to the first boiler using the closed loop steam boiler system of claim 1, the method comprising:

providing make-up water to the second boiler;

generating make-up steam from the make-up water in the second boiler; and directing the make-up steam into the deaerator.

10. The method of claim 9 further comprising:

diverting a portion of the steam flow from the first boiler to the second boiler, the diverted steam flow providing a heat source for the second boiler to facilitate said generating make-up steam from the make-up water.

11. The method of claim 10, wherein the closed loop steam boiler system further comprises the make-up water subsystem to facilitate said providing make-up water to the second boiler, the make-up water supply subsystem including a heat exchanger, and wherein the method further comprises passing the make-up water through the heat exchanger prior to said providing make-up water to the second boiler.

12. The method of claim 11, further comprising purging blow down water from the first boiler and passing the blow down water through the heat exchanger whereby the heat from the blow down water is partially transferred to the make-up water passing through the heat exchanger.

13. A closed loop steam boiler system comprising:

a first boiler configured to produce a high pressure high temperature steam flow;

a turbine-generator fluidly coupled to the first boiler and configured to receive the steam flow from the first boiler and generate electricity therefrom;

a deaerator fluidly coupled to the turbine-generator, the deaerator configured to receive water condensed from the steam and deaerate the condensed water;

a condensation tank located fluidly between the turbine-generator and the deaerator at least one conduit extending between the deaerator and the first boiler, the one conduit configured to carry the condensed water from the deaerator to the first boiler;

a make-up water subsystem, the make-up water subsystem including, a second boiler including a heat source configured to generate make-up steam from make-up water contained therein, the second boiler being comprised substantially of stainless steel, one or more first conduits fluidly coupling the second boiler to a water source configured to provide the make-up water to the second boiler, one or more second conduits fluidly coupling the second boiler to the deaerator, and being configured to provided make-up steam to the deaerator, the one or more second conduits being substantially comprised of stainless steel;

one or more third conduits including a first actuation valve contained therein, the third conduits configured to facilitate the flow of make-up water out of the second boiler as blow down water;

a level sensor within the second boiler, the level sensor being operatively coupled to one or more second actuation valves located along the one or more first conduits;

a dissolved solids sensor located within the second boiler, the dissolved solids sensor being operatively coupled to the first actuation valve;

wherein the one or more first conduits comprise components of a make-up water supply subsystem, the make-up water supply subsystem including one or more water softeners configured to treat make-up water from the water source and a circulation loop, the circulation loop further including one or more pieces of conduit, a pump and a heat exchanger wherein pressurized make-up water is circulated in the circulation loop passing through the heat exchanger to scavenge heat therefrom, and wherein the one or more third conduits pass through the heat exchanger operatively acting to transfer heat from the blow down water received into the heat exchanger from the second boiler to the make-up water;

one or more fourth conduits fluidly extending between the first and second boilers; the fourth conduits including one or more third actuation valves to permit the flow of water or steam from the first boiler to the second boiler when opened; and a flash tank, the flash tank being located between the first boiler and the second boiler along the fourth conduits permitting the flow of water or steam therethrough;

wherein blow down of the first boiler comprises opening the one or more third actuation valves to permit the flow of water or steam from the first boiler to the second boiler within the fourth conduits and through the flash tank.

* * * * *